US006171103B1

(12) United States Patent
Orlandi

(10) Patent No.: US 6,171,103 B1
(45) Date of Patent: Jan. 9, 2001

(54) CANDLE DECORATING KIT AND METHOD

(76) Inventor: Janice Orlandi, 106 Perry St., New York, NY (US) 10014

( * ) Notice: Under 35 U.S.C. 154(b), the term of this patent shall be extended for 0 days.

(21) Appl. No.: 09/199,527

(22) Filed: Nov. 25, 1998

(51) Int. Cl.[7] ..... F23D 3/16
(52) U.S. Cl. ..... 431/295; 431/289; 44/531
(58) Field of Search ..... 431/289, 295, 431/288, 290, 291, 293, 126, 325; D26/6, 9, 13, 15; 362/447, 161; 44/530, 531, 532, 533; 211/49.1, 194; 206/499, 821

(56) References Cited

U.S. PATENT DOCUMENTS

| | | | | |
|---|---|---|---|---|
| D. 76,687 | | 10/1928 | Hurley . | |
| D. 130,991 | | 1/1942 | Gray . | |
| D. 236,234 | | 8/1975 | Hansen . | |
| D. 247,026 | | 1/1978 | Sterniske . | |
| D. 257,641 | | 12/1980 | Taylor . | |
| D. 353,850 | | 12/1994 | Hrsel et al. . | |
| D. 370,283 | | 5/1996 | Simon . | |
| 735,724 | * | 8/1903 | Woody | 431/295 |
| 2,115,962 | | 5/1938 | Orme . | |
| 2,310,019 | * | 2/1943 | Hamblet | 431/295 |
| 2,324,723 | * | 7/1943 | Powers et al. | 431/293 |
| 2,541,725 | | 2/1951 | Sundell . | |
| 2,584,563 | * | 2/1952 | Duncan | 431/288 |
| 3,124,247 | * | 3/1964 | Churchill | 431/289 |
| 3,388,960 | * | 6/1968 | Cangialosi | 431/288 |
| 3,438,363 | * | 4/1969 | Milbrandt | 431/291 |
| 3,637,335 | * | 1/1972 | Uhl | 431/291 |
| 3,744,956 | * | 7/1973 | Hess | 431/126 |
| 4,225,552 | * | 9/1980 | Chang | 431/288 |
| 4,555,231 | * | 11/1985 | Kustka | 431/288 |
| 4,826,428 | * | 5/1989 | Lam | 431/289 |
| 5,405,135 | | 4/1995 | Embro . | |
| 5,660,281 | * | 8/1997 | James | 431/295 |
| 5,660,387 | | 8/1997 | Stokes . | |
| 5,722,540 | * | 3/1998 | Laird et al. | 206/821 |
| 5,927,964 | * | 7/1999 | Fawcett | 431/289 |

FOREIGN PATENT DOCUMENTS 0 675 320 * 10/1995 (EP) .

* cited by examiner

*Primary Examiner*—Carl D. Price
*Assistant Examiner*—Josiah C. Cocks
(74) *Attorney, Agent, or Firm*—Kramer Levin Naftalis & Frankel LLP; Gregor N. Neff

(57) ABSTRACT

The kit consists of a container holding a plurality of candles of a first predetermined size and shape such that the candles can be assembled together to form a regular geometric solid of a geometric shape different from that of the individual candles. Specific embodiments of the invention include candles shaped like triangular prisms forming a square-cross-section solid when assembled together, combinations of L-shaped and cylindrical candles forming a solid of square-cross-sectional shape, as well as candles forming solids having octagonal, hexagonal, circular, etc. cross-sectional shapes when assembled in the kit. When removed from the container, the candles in the kit can be arranged in a variety of decorative patterns, including the pattern used in the kit.

17 Claims, 4 Drawing Sheets

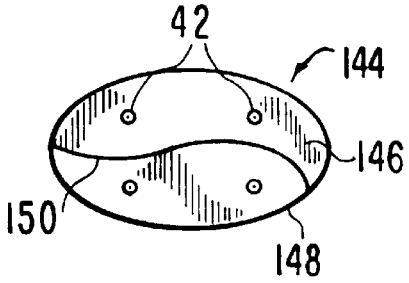
FIG.17
FIG.18
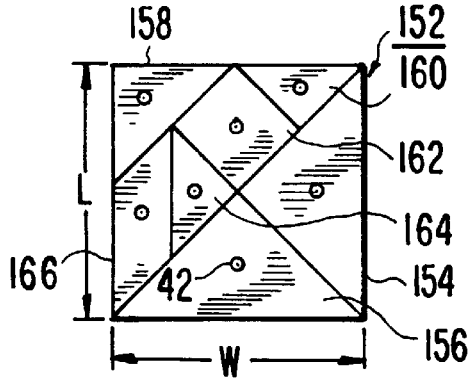
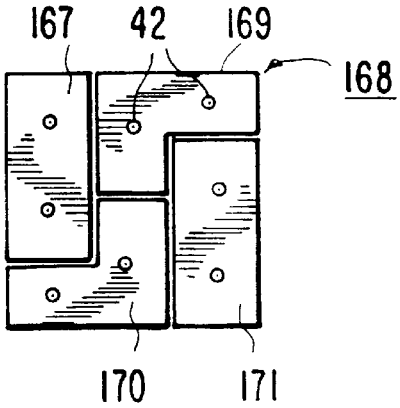
FIG.19
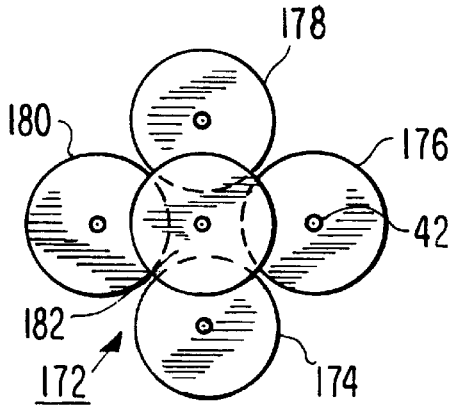
FIG. 20
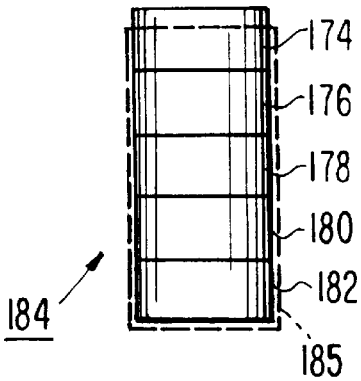
FIG. 21
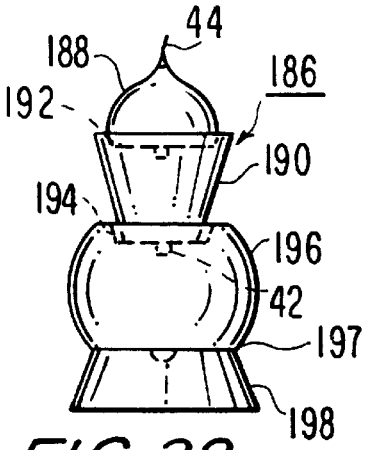
FIG. 22

CANDLE DECORATING KIT AND METHOD

This invention relates to candle decorating kits and methods, that is, kits containing specially shaped candles which can be used to make a variety of candle arrangements, assemblages or tableau.

Decorative candles are produced which have widely varying and imaginative shapes. Individual candles having a triangular, square or cylindrical cross-sections, as well as candles molded into a vast variety of symbolic and artistic forms, are well-known.

Candles often are clustered together in groups to form a decorative assemblage or array. However, the grouping usually is selected at random by the individual decorator, and the candles are purchased separately for assembly into a decorative array.

One problem with this approach is that the packaging and time needed to gather the candles for such arrays can be wasteful in terms of time and money so that the most effective decoration using such candles can be relatively costly and time consuming.

Accordingly, it is an object of the present invention to overcome or alleviate the foregoing problems, and to provide a candle decorating kit in which the candles are predesigned as a group and packaged in a compact, efficient and relatively low cost container so that decorative arrays can be composed from the contents of the kit quickly, easily and at a relatively modest cost.

In accordance with the present invention, the foregoing objects are met by the provision of a candle decorating kit and method which preferably includes a plurality of candles fitted into a container in an arrangement in which they form a geometric solid of a shape different from that of at least some of the candles in the container.

For example, a kit is provided in which candles with triangular and other cross-sections are assembled together in a container to form a rectangular prismatic solid, such as a rectangular parallelpiped, preferably a cube. This combination provides the maximum in packaging efficiency and, unexpectedly, provides added versatility in decoration. The added versatility comes from the fact that the geometric solid formed by the candle array in the package is one option for use of the candles in a decorating scheme, in addition to using the triangular candles in other arrays.

Also, a candle having one side wall with a re-entrant curved surface is matched with another candle of having the mirror image of that surface so that when fitted or "nested" together the candles again form a rectangular parallelpiped, such as a cube.

Similarly, the candles in the kit can form a cylinder or an octagon, or a hexagon or an ellipsoid or other geometric solid, such as a heart, pyramid, and can include a truncated pyramid, truncated cone, hemisphere, etc.

Another feature of the invention is that the candles have flat tops with recessed wicks in order to permit the stable stacking of the candles atop one another, if desired, either for decorative effect or packaging in the kit.

The foregoing and other objects and advantages of the invention are set forth in or will be apparent from the following descriptions and drawings.

IN THE DRAWINGS

FIGS. 7, 8, 9, 10, 11, 12, 13, 16, 17, 18, 19, 20 and 22 are top plan views of other candles arranged in decorating kits in accordance with the present invention;

FIG. 20 is a top plan view of a decorative array of candles;

FIG. 21 is a side-elevation view of a candle decoration kit filled with the candles shown in FIG. 20; and FIG. 22 is a side elevation view of another kit constructed in accordance with the present invention.

GENERAL DESCRIPTION

Figure 1:
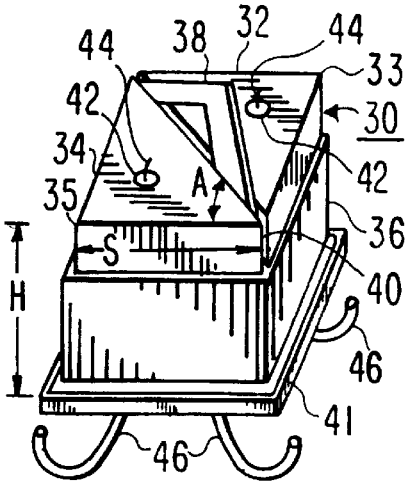
FIG. 1 is a perspective view of a candle decorating kit constructed in accordance with the present invention.

FIG. 1 is a perspective view showing a candle decorating kit 30 constructed in accordance with the present invention.

The kit 30 includes first and second triangular candles 32 and 34, and a container 36 of square cross-section and having a handle 38 extending upwardly through a crevice 40 between the two candles 32 and 34. The container can be made of cardboard, plastic or other relatively inexpensive materials.

The cross-section of each of the candles 32 and 34 is a right triangle; that is, the angles of the candle tops at the corners 33 and 35 are 90 degrees, and each of the other angles A is a 45 degree angle.

The surface formed at the hypotenuse of each triangle forming the cross-section of each candle abuts against the surface formed by the hypotenuse of the other candle, except for the fact that the material of handle 38 separates the two.

Preferably, the height H of each candle is equal to the width S of the assembled candle structure. Since the top of the candles is formed of two right triangles, the top is a square so that all four sides of the assembled candle structure are of equal length S, and the candle array forms a cube.

Figure 3:
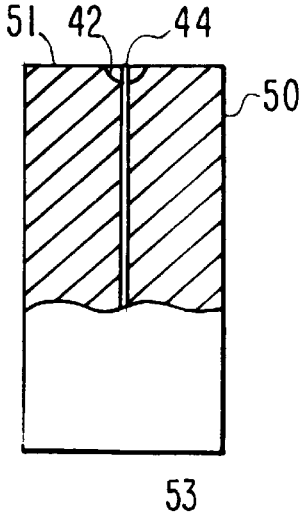
FIG. 3 is a partially cross-sectional view of one of the candles in the kit of FIG. 2, taken along line 3—3 of FIG. 2.

Referring now to FIG. 3 as well as FIG. 1, each of the candles 32 and 34 (as well as all other candles described in this patent application, except as noted) has a wick 44 located in a recess 42 in the flat top of the candle.

The candle kit 30 rests upon a platform 41 with legs 46 which can be used to support the candle structure, if desired.

When the candles are removed from the container 36, they can be arranged in any pattern desired. In fact, if desired, the two triangle candles can be arranged in the same pattern as when they were when contained in the kit; that is, forming a cube having two wicks. That cube can rest on the platform 41, or can be placed on any other flat surface desired.

Figure 2:
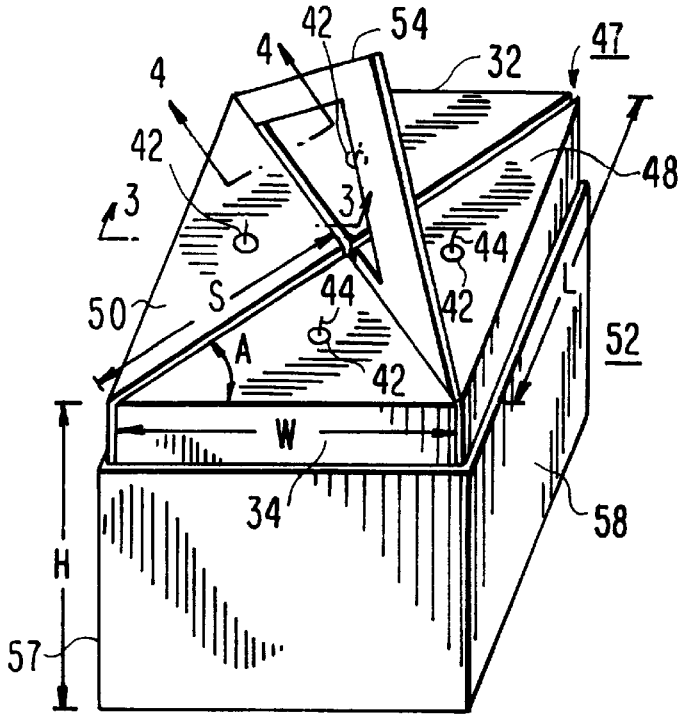
FIG. 2 is a perspective view of another candle decorating kit of the present invention.

FIG. 2 shows another kit 47 of the invention with four triangular candles like those in FIG. 1. Accordingly, two of the candles are indicated by reference numerals 32 and 34. The other two candles 48 and 50 are of identical triangular shape. Each has a wick 44 in a recess 42 on a flat top.

The triangular candles are arranged with their short sides S abutting rather than their long sides or hypotenuses abutting as shown in FIG. 1.

A square cross-section container 52 is provided with a handle 54 extending upwardly into the gap between opposite pairs of candles. The width W of the candle array is equal to the length W, and the height H is also equal to the width so that the candle structure 47 again is a cube. For the sake of clarity in the drawings, the candles shown in FIG. 2 are larger than those shown in FIG. 1.

FIG. 3 is a cross-section taken along line 3—3 of FIG. 2 through the candle 50. The candle 50 and each other candle in this patent application has a flat top 51 and a flat bottom 53. The top of the wick 44 of the candle extends upwardly through a recess 42 in the top of the candle and is trimmed so that its tip is even with, or slightly below or slightly above the top of the candle. By this means, a flat top surface is formed so that two candles can be stacked on top of one another without interference by the wick. Thus, the candles can be stacked stably to form an array for packaging in the kit, or for decoration.

Figure 4:
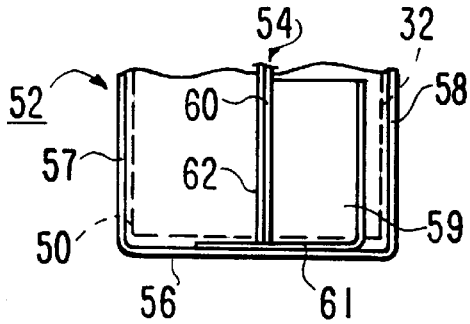
FIG. 4 is a cross-sectional view taken along line 4—4 of FIG. 2, showing the bottom left corner of the container of the kit shown in FIG. 2 and the handle structure of the kit.
Figure 5:
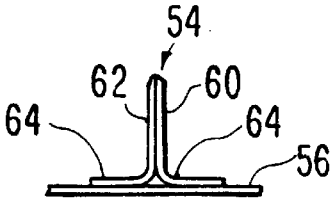
FIG. 5 is a cross-sectional view which shows an alternative handle construction for the kit.

Referring now to FIGS. 4 and 5, two alternative structures for the formation of the handle 54 or 38 are shown.

In the FIG. 4 structure, the handle 54 is formed by two panels 60 and 62 integral with the container and folded over on one another. The two side walls of the container adjacent the rear left corner of the container are shown by reference numbers 57 and 58. Reference number 56 indicates the bottom wall of the container. A flap 59 extends outwardly from the rear edge of the panel 62 and is wrapped around the rear edge of the panel 60 and bears against the wall 58.

A further flap 61 extends from the flap 59 and rests on the bottom wall 56 underneath the candles 50 and 32 and the lower edges of the panels 60 and 62.

The opposite edges of the panels 60 and 61 (not shown) are attached to the side walls of the container. Thus, when the kit is lifted by the handle 54, the weight of the candles is supported by the flap 61 and this holds the container together. Thus, the container walls and the handle can be made of a single folded piece of cardboard.

The alternative structure down in FIG. 5 shows the panels 60 and 62 as separate panels secured by adhesives at 64 to the bottom panel 58 of the container 52.

The central location of the handle 54 or 38 makes it convenient for carrying the decoration kit. Of course, the centrally located slot between pairs of candles or between candles themselves provides a central location for the handle, thus allowing the structure to be well balanced when being carried.

Figure 6:
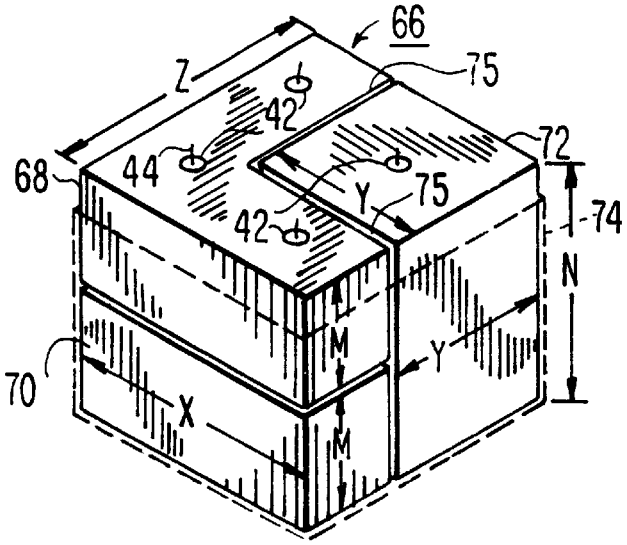
FIG. 6 is a perspective view of another candle decorating kit of the present invention.

FIG. 6 is a perspective view of another candle kit 66 constructed in accordance with the invention. The candle kit 66 consists of a pair of L-shaped candles 68 and 70 of the same size, and a rectangular candle 72 which is twice the height of the other two candles and has a width Y such as to fit into the notch indicated generally at 75 cut into the otherwise square shapes of the candles 68 and 70. Thus, when the individual candles are assembled in the shape shown in FIG. 6, they again form a rectangular parallelpiped structure. Preferably, the height N of the structure is equal to the width Z of the structure so that again the package of assembled parts forms a cube. The thickness M of each of the two L-shaped candles is equal to one-half of the height N of the rectangular candle 72. When these candles are removed from the package, they can be used in many different arrangements, such as one in which each of the L-shaped candles surrounds a portion of the base of the rectangular candle, with the L-shaped candles on opposite sides. Many other arrangements are possible, including ones with one of the candles 68 remaining atop the other.

Each of the candles 68 and 70 has three receptacles 42 and wicks 44.

Additional wicks can be added to or subtracted from each of the candles shown in this patent application as long as proper candle construction principles are adhered to so as to not place the wick too close to one side of the candle and create melt-through or other damage to the candles.

Figure 7:
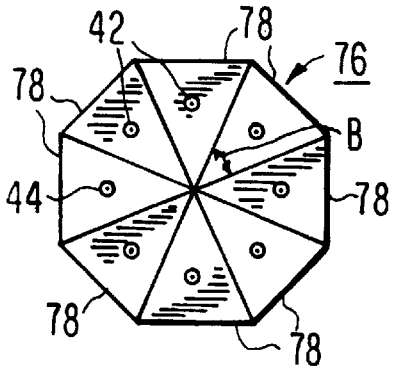

FIG. 7 shows an octagonal kit 76 of the present invention. Each of the individual candles 78 is a triangle 78 with a wick 44 and recess 42 in the top. Each triangular cross-section of each candle has an included angle of B which is equal to 45 degrees.

Although it is not shown, the container holding the kit 76 also preferably is of octagonal shape and can have a handle, such as the handle 38 or 54, extending upwardly through the gap between two halves of the array of candles.

Again, the candles 78 can be arranged in a variety of different patterns pleasing to the individual eye and tastes, either in the pattern shown in FIG. 7, or another pattern.

Figure 8:
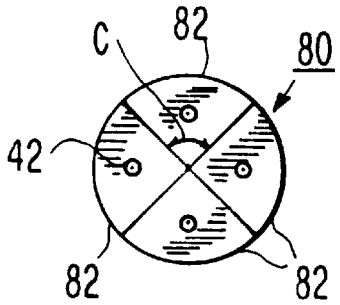

FIG. 8 shows a cylindrical array 80 of four triangular candles 82, each of which has an included angle C equal to 90 degrees. The cross-section of each candle has essentially the shape of a sector of a circle. Preferably, the container (not shown) for the candle array 80 is cylindrical, and a handle also is provided, as in the preceding embodiments of the invention.

Figure 9:
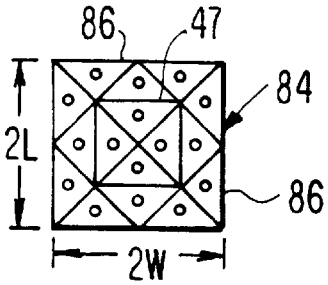

FIG. 9 shows a variation of the candle structure shown in FIG. 2. The arrangement of four candles 47 shown in FIG. 2 is at the center of the array 84. Another row of identical triangular candles is arranged as shown around the perimeter of the array 47. These candles 86 thus form a new and larger array of square cross-section whose dimensions are 2L and 2W, respectively.

It can be seen readily that the square formed by the triangular candles shown in FIG. 2 can be increased in size almost indefinitely simply by adding circumferential rows of suitably arranged candles or the same shape. Thus, the kit can have a length and width equal to multiples of the length L and width W of the unit shown in FIG. 2. The size of the array in FIG. 1 also can be increased in the same way, except that the cross-section of the resulting solid will be a rectangle instead of a square.

Figure 10:
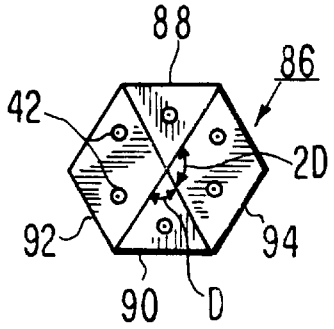

FIG. 10 is a cross-sectional view of a candle array 86 of hexagonal shape. The container for the array 46 preferably is hexagonal in shape, and has a centrally-located handle.

The array 86 includes two triangular shaped candles 88 and 90 whose included angle D is equal to 60 degrees, and two candles 92 and 94 with diamond shaped cross-sections, arranged between the candles 88 and 90 as shown. The included angle of each of the diamond shaped candles is equal to 2D or 120 degrees.

Each of the diamond shaped candles has two wicks 44 and recesses 42.

Figure 11:
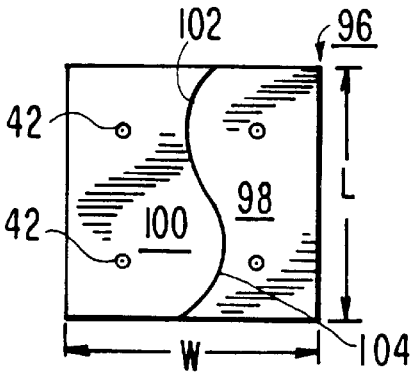

FIG. 11 shows another candle decoration kit 96 comprised of two nesting candles 98 and 100 and a container (not shown). Each of the two halves of the candle has one wall having a re-entrant shape, such as at 102 and 104, which perfectly matches a wall of the other half of the other candle structure so that when the two halves are mated together or nested, as shown in FIG. 11, they again form a square in which the length L and the width W are the same.

A handle similar to handle 54 is provided. It is bent to conform to the curves 102 and 104.

Each of the candles 98 and 100 has at least two wicks 44 and recesses 42.

Figure 12:
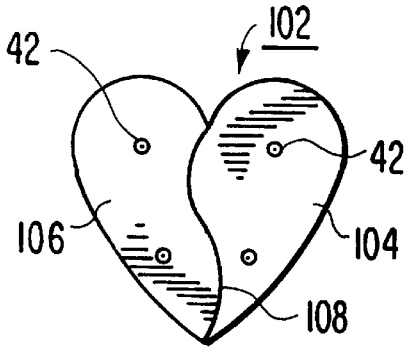

FIG. 12 shows another example of a nesting candle pair. The kit 102 consists of two candles 104 and 106 shaped on their outside surface so that when they are assembled together with the curved surfaces at 108 nested into one another, the overall outline of the candle assembly is that of a heart. Again, two wicks 44 and two recesses 42 are provided for each half of the candle.

Preferably, the container for the candle assembly 102 also is heart-shaped so that the assembly shown in FIG. 12 will quite often be used as the decoration provided by the kit. Again, as with the FIG. 11 embodiment, a bent handle can be used.

Figure 13:
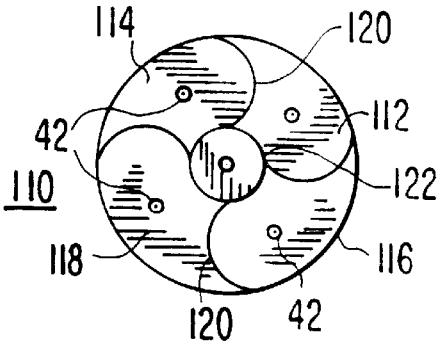

FIG. 13 shows a kit 110 with a cylindrical candle assembly. A cylindrical container (not shown) is used. The assembly consists of a cylindrical core candle 122 and four segments 112, 114, 116 and 118 forming a circle on the outside surface when assembled together along curved lines 120. Each of the segments 120 is separable from the core and from the other segments to form individual candles in a decorative array.

Preferably, each of the five segments of the candle kit 110 has at least one wick and recess 42.

Figure 14:
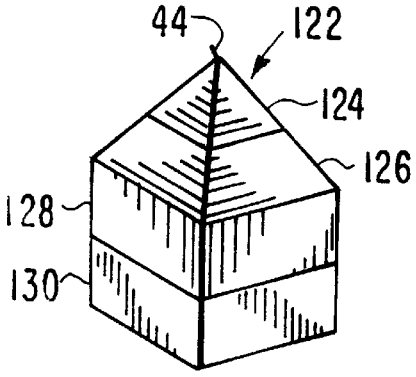
FIG. 14 is a perspective view of another embodiment of the present invention.

FIG. 14 shows a stacked candle kit 122 consisting of a top pyramid 124 with a wick 44 extending from the top (and a recess 42, if necessary) stacked atop of a truncated pyramid 126 whose top surface area and shape match that of the bottom surface of the pyramid 124.

The truncated pyramid 126 is stacked on top of rectangular candle arrays 128 and 130 whose cross-section matches that of the bottom of the pyramid 126.

The kit 122 preferably has a specially-shaped container (not shown) to hold the pyramid 124 in place to keep it from sliding around in the package. The kit forms a unique pyramidal structure. The array can be left in that form, if desired for decorative purposes, or the parts can be arranged in other patterns.

Figure 15:
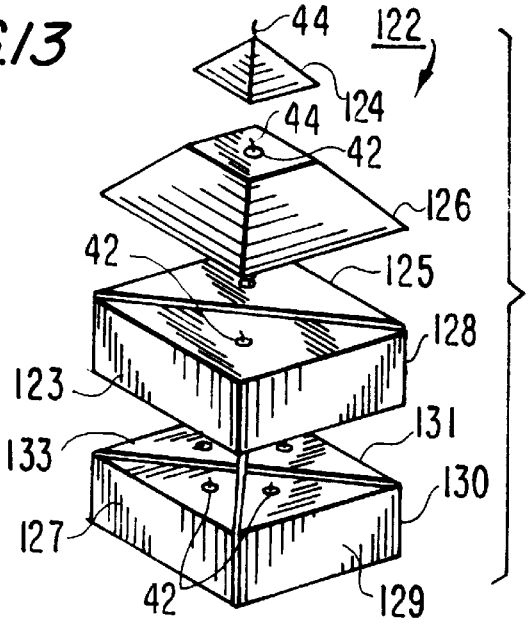
FIG. 15 is an exploded view of the embodiment shown in FIG. 14.

FIG. 15 is an exploded view of the candle array in the kit 122 illustrating the fact that there are several wicks and recesses 42 in each of the rectangular candle arrays 128 and 130, and a single recess 42 and wick 44 in the top surface of the candle 126.

Although each candle array 128, 130 can be solid, preferably the candle 128 array is made, like the array 30 of FIG. 1, of two right triangular candles 123 and 125. Similarly, candle array 130 is made of four right triangular candles 127, 129, 131 and 133, like the array shown in FIG. 2.

Figure 16:
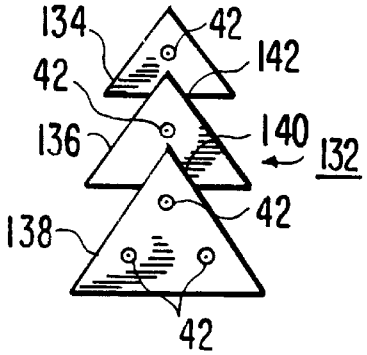

FIG. 16 shows another group of nested candles consisting of a triangular base 133, a smaller triangle 136 with a recess 140 into which the upper point of the triangle 138 fits, and a third triangle 134 with a recess 142 into which the top of the triangle 136 fits. Each of the candles has from one to three recesses and wicks.

As it can be seen in FIG. 16, the assembled candles form a shape imitating that of a Christmas tree. Again, the candle 138 is a triangular prism, as are the candles 134 and 136 except for the presence of a notch 140 or 142 into which the other candle parts are nested.

FIG. 17 shows an elliptical candle kit 144 consisting of two individual candles 146 and 148. Each has a curved surface 150 which nests with a matching surface so that when the halves are assembled together they form a candle array with an elliptical cross-section. Preferably, the container (not shown) also has an elliptical cross-sectional shape, and a bent handle can be used.

FIG. 18 shows a candle decorating kit 152 in which the candles also form a cube when assembled together. The cross-sections of the candles match the shapes of the components of an old Chinese puzzle known as a "tangram". Specifically, the array contains two right triangles 154 and 156 occupying half of the space of the square cross-section of the array, three other smaller right triangles 158, 160 and 164, a square 162, and a parallelogram 166.

As it is well known, these specific shapes may be assembled together to form various figures, such as human imitations and imitations of animals, etc. This is merely another example of diverse candle shapes which can be planned and selected as to size and shape so as to form other geometric solids when assembled together.

FIG. 19 is another cubic candle kit 168, also with a square container (not shown) with four candles 167, 169, 170 and 171. Two of the candles 169 and 170 are rectangular, and two, 169 and 170, are L-shaped. When they candles are nested together, as shown in FIG. 19, they form a square.

FIG. 20 shows a decorative array 172 of candles formed by use of a cylindrical candle kit 184 shown in FIG. 21. The candle kit 184 consists of a cylindrical container 185 containing five short cylindrical candles 174, 176, 178, 180 and 182.

FIG. 20 shows those candles arranged in the array 172 in which the candle 182 rests atop a portion of each of the other four candles to elevate it above the other candles. Thus, all five candles can burn simultaneously and form a pleasing display. This is only one example of the many ways in which the candle components can be assembled into a decorative structure.

FIG. 22 shows a candle decoration kit 186 including rounded or hemispherical elements and vertically nested elements. The first candle 188 is dome-shaped with a wick 44 and a flat bottom which rests in a recess 192 in the top of a truncated inverted, rounded, frusto-conical candle 190. The flat bottom of the candle 190 fits into a recess 194 in the top of a hemispherical candle 196 with a flat bottom 197 which rests on the flat top of a frusto-conical candle 198. Each candle 190, 196 and 198 has at least one recessed wick.

The recesses 192 and 194 which also can be used with other candles to be stacked on top of one another, are provided to prevent the top candle from easily sliding off the candle upon which it rests.

As it is readily apparent from the foregoing, the invention satisfies the objectives set forth above admirably. The fact that each of the arrays of candles forms a compact geometric solid makes it efficient in the usage of packaging materials and shipping and storage space until it is removed from the package for use in decoration.

An added benefit is obtained when the geometric solid formed by the array of candles in the kit container is useful itself in decorating. Therefore, a dual purpose is served by the unique candle decorating kits provided by the present invention.

The candle decorating kits also have symmetry and balance in appearance. This is apparent in many of the embodiments of the invention, such as those shown in FIGS. 1, 2, 6–17, and 19–22.

The kits also maintain a sense of proportion of components in the kits to the whole solid structure or tableau formed by the candles. Harmony thus is maintained.

The above description of the invention is intended to be illustrative and not limiting. Various changes or modifications in the embodiments described may occur to those skilled in the art. These can be made without departing from the spirit or scope of the invention.

What is claimed is:

1. A candle decorating kit, said kit comprising, in combination, a container for a plurality of candles each of said candles having at least one side wall, a top and a wick located substantially inwardly from each side wall, each of said candles having a predetermined size and shape such that said candles can be assembled together to form a geometric solid of a geometric shape different from that of said candles, said container having a bottom wall and at least one side wall joined to said bottom wall and forming a compartment having the shape of said geometric solid, whereby said candles substantially fill said compartment.

2. A kit as in claim 1 in which said shape of said solid is selected from the group consisting a rectangular prism; a hexagonal prism; an octagonal prism; a pyramid; a solid with at least one hemispherical element; a solid with at least one frusto-conical element; an ellipsoid; and a heart-shaped solid.

3. A kit as in claim 1 in which said container has at least one vertical side wall and a central vertical divider wall which extends upwardly between and above the tops of the candles in said container and has a grip for use as a carrying handle.

4. A kit as in claim 1 in which said candles have a right triangular cross-section and said shape is a rectangular parallelpiped.

5. A kit as in claim 1 in which said candles have diamond and triangular cross-sections and fit together to form a solid with a hexagonal cross-section.

6. A kit as in claim 1 in which said candles comprise a pair of generally L-shaped candles, each having a notch, and being of a given height, and a rectangular candle of twice said height and with a cross-section dimensioned to fill said notch, whereby said candles can be assembled to form a rectangular parallelpiped with one of said L-shaped candles being positioned atop the other and said notches being aligned vertically, and said rectangular candle filling said notches.

7. A method of making a candle decorating kit, said method comprising the steps of (a) providing a plurality of candles of size and shape predetermined to allow said candles to be assembled together into a geometric solid of a larger size than, and a shape different from, at least some of said candles, each of said candles having a body with at least one side wall and a wick located in said body substantially inwardly from all parts of said side wall, (b) providing a container to the shape of said solid, (c) assembling said candles to form said solid in said container.

8. A method as in claim 7 in which said shape is selected from the group consisting of; an octagon; a hexagon; a cylinder; a pyramid; a cube; a solid with at least one hemispherical or dome-shaped or frusto-conical or frusto-pyramidal element.

9. A method as in claim 7 in which said container has a central upstanding separator wall and said assembling step comprises positioning said candles symmetrically below the top of and on opposite sides of said separator wall.

10. A method as in claim 7 in which each of said candles is a prism which has a right triangular cross-section, with two equal-length legs defining short side surfaces of the candle, and a hypotenuse defining a wide side surface of said candle, said container having a receiving chamber of square cross-section, said assembling step comprising a procedure selected from the group consisting of; placing two of said candles in a container with their wide surfaces abutting one another, said chamber of said container having sides whose widths are approximately equal to the length of the legs of said triangular cross-section; and placing four of said candles in a container whose sides have approximately the length of the hypotenuse of said triangle, with the short side surfaces of each candle abutting the short side surface of two adjacent candles.

11. A method as in claim 7 in which each of said candles is a prism which has a right triangular cross-section, with two equal-length legs defining short side surfaces of the candle, and a hypotenuse defining a wide side surface of said candle, said container having a receiving chamber of square cross-section, said assembling step comprising assembling said candles to form a rectangular prism in said receiving chamber.

12. A method as in claim 11 in which the number of candles in said kit is an even number and the widths of the sides of said chamber are a multiple of the width of one of the sides of said candles.

13. A method as in claim 11 in which the candles comprise two L-shaped parallelpipeds with a notch and one rectangular parallelpiped sized to fill said notches, said L-shaped candles having flat tops with recessed wicks, said assembling step comprising stacking said L-shaped candles atop one another and fitting said rectangular candle into said notches whereby the geometric solid formed is a cube.

14. A method as in claim 7 in which said candles have side walls with a re-entrant curved shaped to nest with others of said candles to form said solid, and said assembling step comprises nesting said candles together.

15. A method as in claim 7 including the step of removing said candles from said container and arranging them in a display for decoration of an enclosed space.

16. A method as in claim 7 in which said shape is selected from the group consisting of; a pyramid; a truncated pyramid; a stacked array of a pyramid atop a truncated pyramid with a flat top area the same side as the bottom of said pyramid; a heart shape; an ellipsoid; and a star.

17. A method as in claim 7 in which at least one candle in said plurality has, when unburned a flat top surface and multiple recesses and wicks in said top surface, with each of said wicks being located in one of said recesses substantially out of the way from contact with the bottom of another candle stacked on top of it, each of said recesses occupying an area substantially less than the total area of said flat top surface.

* * * * *